US005813334A

United States Patent [19]

Blanchard

[11] Patent Number: 5,813,334

[45] Date of Patent: Sep. 29, 1998

[54] CYLINDER WITH A PRINTING COVER FOR OFFSET PRINTING

[75] Inventor: Alain Blanchard, Gouvieux, France

[73] Assignees: Heidelberger Druckmaschinen AG, Heidelberg, Germany; Heidelberg Harris, S.A., Montataire Cedex, France

[21] Appl. No.: 686,379

[22] Filed: Jul. 25, 1996

[30] Foreign Application Priority Data

Jul. 25, 1995 [FR] France ..... 95 09002

[51] Int. Cl.[6] ..... B41F 7/02; B41F 23/04

[52] U.S. Cl. ..... 101/217; 101/487; 101/375

[58] Field of Search ..... 101/217, 487, 101/375, 376

[56] References Cited

U.S. PATENT DOCUMENTS

| | | | |
|---|---|---|---|
| 2,752,280 | 6/1956 | Cooke et al. | 428/76 |
| 3,235,772 | 2/1966 | Gurlo | 361/214 |
| 4,599,943 | 7/1986 | Köbler | 101/217 |
| 4,759,285 | 7/1988 | Fox et al. | 101/170 |
| 4,913,048 | 4/1990 | Tittgemeyer | 101/375 |
| 5,595,115 | 1/1997 | Rau et al. | 101/487 |

FOREIGN PATENT DOCUMENTS

| | | |
|---|---|---|
| 0 179 363 A2 | 4/1986 | European Pat. Off. . |
| 0 441 114 A1 | 8/1991 | European Pat. Off. . |
| 912 685 | 8/1946 | France . |
| 2 630 042 | 10/1989 | France . |
| 606 888 | 8/1948 | United Kingdom . |
| 1 110 078 | 4/1968 | United Kingdom . |
| 1 407 546 | 9/1975 | United Kingdom . |
| 1 426 294 | 2/1976 | United Kingdom . |
| 1 515 342 | 6/1978 | United Kingdom . |
| 2 016 373 | 9/1979 | United Kingdom . |
| 2 273 464 | 6/1994 | United Kingdom . |
| 2 296 496 | 7/1996 | United Kingdom . |
| 93/01003 | 1/1993 | WIPO . |

OTHER PUBLICATIONS

Patent Abstracts of Japan, vol. 12, No. 201 [M–707] Oct. 6, 1988 & JP–A–86–0149587 (TORAY) Jan. 11, 1988.

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

Offset printing cylinder is formed of a basic cylinder body and a printing cover disposed on an outer cylindrical surface of the cylinder body, the printing cover including a plurality of layers of which at least one is a heat-removing layer having a location selected from a group thereof consisting of a location intermediate two other layers of the printing cover and a location at the bottom of the printing cover.

8 Claims, 1 Drawing Sheet

CYLINDER WITH A PRINTING COVER FOR OFFSET PRINTING

BACKGROUND OF THE INVENTION

FIELD OF THE INVENTION

The invention relates to a cylinder with a printing cover for offset printing and, more particularly, to a blanket cylinder preferably for offset printing without any dampening agent, the blanket cylinder being formed of a cylindrical body covered with a printing cover, such as a rubber blanket particularly.

A rotary offset printing press which uses a dampening agent has, as essential components, a dampening unit and an inking unit, a plate or form cylinder with a printing plate or form, a blanket cylinder and an impression cylinder. The dampening unit dampens the printing plate or form which has a subject applied thereto, while the inking unit deposits the ink on predetermined parts of the printing plate or form, and the resultant printing image is then transferred to the blanket cylinder from which the image is further transferred to printing material or stock, such as paper, for example.

Heretofore known blanket cylinders have a cylindrical body carrying on the outer cylindrical surface thereof a printing cover or covering, such as a rubber blanket, particularly. The blanket is preferably formed with several layers. It includes, for example, a shell or carcass intimately bonded to a layer of elastic material having a given degree of compressibility. In order to exert an influence upon or adjust the location, particularly the height, of the blanket with respect to that of the blanket cylinder, dressings or packings usually formed of one or more sheets of plastic material of calibrated thickness are suitably interposed.

A multilayer printing cover has become known heretofore from U.S. Pat. No. 4,812,357.

The German Published Non-Prosecuted Patent Application DE-OS 28 03 908 describes a blanket cylinder, in particular for off-set printing, which has several layers and carries therebeneath a thin, flexible foil-type ferromagnetic metal plate which serves for magnetically securing the layers to the cylindrical basic body of the cylinder. Thus, the printing cover may be fixed to the basic cylindrical body of the cylinder without any mechanical fastening means. The printing cover does not have a cylindrical shape closed on itself, but rather, is slotted.

In addition to the aforementioned offset printing process with dampening agent and ink, printing without any dampening gent is also been known heretofore, wherein the printing form or plate receives only ink, but no dampening agent. This type of printing process requires that the press components have defined parameters and that the defined process values or quantities be respected. Thus, it is necessary to maintain the temperature of the printing form or plate constant within a narrow tolerance range. Likewise, for the conventional off-set printing process performed with a dampening agent and ink, it is advantageous that prescribed temperature requirements be respected. Of course, it is possible to perform the printing over a wide temperature range, which is not the case for printing without a dampening agent, however, maintaining the temperature at an optimum value ensures uniform quality.

SUMMARY OF THE INVENTION

It is accordingly an object of the invention to provide a cylinder with a printing cover for offset printing, i.e., an off-set printing cylinder, in particular a blanket cylinder, which facilitates temperature regulation, i.e., heat exchange or transfer between the printing cover and the cylinder body.

With the foregoing and other objects in view, there is provided, in accordance with the invention, an offset printing cylinder formed of a basic cylinder body and a printing cover disposed on an outer cylindrical surface of the cylinder body, the printing cover comprising a plurality of layers of which at least one is a heat-removing layer having a location selected from a group thereof consisting of a location intermediate two other layers of the printing cover and a location at the bottom of the printing cover.

In accordance with another feature of the invention, the heat-removing layer forms a heat-conducting path to the cylinder body.

In accordance with a further feature of the invention, the printing cover is formed of a sleeve-shaped blanket.

In accordance with an added feature of the invention, the heat-removing intermediate layer is formed of a sleeve-shaped body embedded in the printing cover.

In accordance with an additional feature of the invention, the heat-removing bottom layer is arranged between the cylinder body and an outer printing-cover substrate disposed thereabove.

In accordance with yet another feature of the invention, the cylinder includes a cooling device arranged inside the cylinder body.

In accordance with yet a further feature of the invention, the heat-removing layer is formed of thermally conductive material selected from the group of materials consisting of metal and synthetic resins.

In accordance with a concomitant feature of the invention, the metal is aluminum or nickel.

Thus, an essential feature of the invention is that the printing cover is formed of at least one heat-removing intermediate layer or a heat-removing bottom layer (hereinafter also referred to as a "heat-exchange layer"). This heat-exchange layer ensures that the temperature of the printing cover, for example the blanket, remains substantially constant. The fulling or squeezing work of the blanket which occurs during the printing process does not result in a temperature rise detrimental to printing quality, because the heat which develops dissipates through the heat-exchange layer to the cylinder body. Consequently, the surface temperature of the blanket may thus remain within the temperature range suitable for off-set printing without a dampening agent. It is thus possible to limit the temperature of the blanket cylinder to a defined value, due to which the printing form rolling off on the surface of the blanket cylinder can also be kept at a constant temperature. It is especially possible to maintain the printing form at a constant temperature, for example at 30° C. plus or minus a small tolerance, for example +/−3° C. The heat generated by the fulling or squeezing work of the blanket is therefore not transmitted to the printing form, but rather, directed via the heat-exchange layer into the cylinder body which, for its part, removes the heat or surrenders it to the environment or, according to one particular embodiment, a cooling device is provided inside the cylinder body. Due to the construction according to the invention, offset printing without a dampening agent or dry offset printing is able to be performed without difficulty, because the temperature of the printing form or plate can be kept at a suitable value. This is a prerequisite for dry printing, which is advantageous for the environment because it is possible to use only the printing form or plate structure or the structure of the subject applied to the printing form or plate in order to determine whether a particular area on the printing form or plate is to take or not take ink.

According to another feature of the invention, heat-removing intermediate layer or the heat-removing bottom layer forms a path for conducting heat to the cylinder body. Thus, heat exchange occurs between the printing cover and the remaining region of the cylinder, which prevents a temperature increase or a build-up of heat at the surface of the printing cover.

In particular, the printing cover is formed of a tubular or sleeve-shaped blanket. This blanket is uninterrupted and therefore forms a path closed on itself.

Moreover, it is advantageous for the heat-removing intermediate layer or the heat-removing bottom layer to be formed of a sleeve-shaped element which is embedded in the printing cover.

This sleeve-shaped element may be a solid body, for example a solid-walled sleeve. However, it is also possible for the heat-exchange layer to be formed of a heat-conductive mesh or of a thermally conductive liner or inlay material. Assurance is thereby always provided that the heat-exchange layer is capable of effecting this exchange so that no unacceptable temperature increase in the blanket cylinder and therefore in the printing form or plate occurs during the printing process, in particular during dry offset printing.

Moreover, it is advantageous that the heat-exchange layer be formed as a heat-removing bottom layer which is located between the cylinder body and a printing cover substrate disposed thereabove. Thus, the printing cover is made up of an inner part placed over the cylinder body, namely the heat-removing bottom layer which is thus directly in contact for heat exchange with the cylinder body. An external printing layer which covers the heat-exchange layer is therefore also in contact over the entire surface thereof with the latter, and any temperature increase is avoided because heat generated in the external printing cover substrate is dissipated via the heat-exchange layer into the basic cylinder body. Of course, it is possible for the aforementioned structure to be provided with one or more heat-removing intermediate layers in addition to the heat-removing bottom layer at the inside of the printing-cover substrate. The heat-removing bottom layer and the external printing-cover substrate are formed, in particular, as a solid unitary member. However, it is also possible for this heat-conducting bottom layer to be formed separate from the external printing-cover substrate. Nevertheless, it is always necessary to adjust the parameters of the heat-removing bottom layer to those of the printing-cover substrate, so as to produce the described path for conducting heat to the cylinder body. When the heat-removing bottom layer is formed as an entity separate from the external printing-cover substrate, it is possible in addition to hold, in reserve, heat-removing bottom layers having different thicknesses, so that, not only is temperature control afforded, but also, the diameter of the blanket cylinder is able to be modified by inserting heat-removing bottom layers of varying thicknesses. This diameter modification or variation permits an adjustment or adaptation to differences in the thickness of the printing material or stock, for example.

It is usually enough to direct the heat from the printing cover to the basic cylinder body by means of the heat-exchange layer in order to achieve the desired temperature control or guidance. If the heat removal via the basic cylinder body is insufficient to keep printing parameters constant, a cooling device may provided as an alternative within the basic cylinder body. For example, a coolant is passed through the interior of the basic cylinder body in order to facilitate the desired temperature control or guidance. Assurance is provided by the heat-exchange layer that the cooling of the basic cylinder body will act all the way to the outer surface of the external printing cover, thereby enabling the desired effect to be achieved, namely, that the temperature of the printing form or plate is accurately maintained, particularly for dry offset printing.

It is further advantageous that the heat-removing intermediate or bottom layer be formed of thermally conductive material such as metal, in particular aluminum or nickel, or such as resins of synthetic materials.

Other features which are considered as characteristic for the invention are set forth in the appended claims.

Although the invention is illustrated and described herein as embodied in a cylinder with a printing cover for offset printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
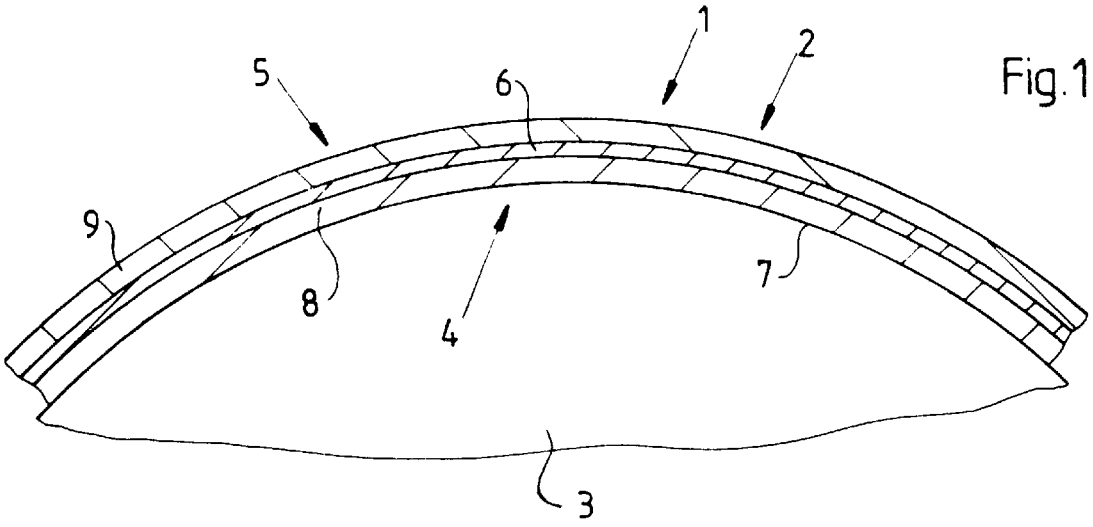
FIG. 1 is a fragmentary diagrammatic cross-section view of a blanket cylinder constructed in accordance with the invention.

Referring now to the drawing and, first, particularly to FIG. 1 thereof, there is shown therein diagrammatically a cylinder 1 of an offset printing press formed as a blanket cylinder 2 having a basic cylindrical body 3 and a printing cover 4 in is the form of a rubber blanket 5 which may be of tubular or sleevelike construction.

The blanket 5 includes a heat-removing intermediate layer 6 forming a heat-exchange layer. The heat-removing intermediate layer 6 is thus embedded in the printing cover 4. Initially, a substrate 8 of the cover, which forms a first layer, is disposed on the outer cylindrical surface 7 of the basic cylinder body 3. The heat-removing intermediate layer 6 covers the first layer 8. An outer printing-cover substrate 9 then covers this intermediate layer 6. Thus, the heat-removing intermediate layer 6 forms a second layer, and the outer printing cover substrate 9 forms a third layer. The first and third layers 8 and 9 may be formed of any one or more different materials in order to provide a shell or carcass having sufficient flexibility and sufficient elasticity.

It is also possible, in accordance with an otherwise non-illustrated embodiment, to embed, in the printing cover 4, several heat-removing intermediate layers 6 of different thicknesses.

The heat-removing intermediate layer 6 forms a heat-conductive path to the cylinder body 3, so that, therefore, temperature increases occurring at the surface and within the printing cover 4 are dissipated into the basic cylinder body 3, i.e., the heat-exchange layer 6 enables the blanket 5 to be maintained at a defined temperature during the performance of the printing process.

Figure 2:
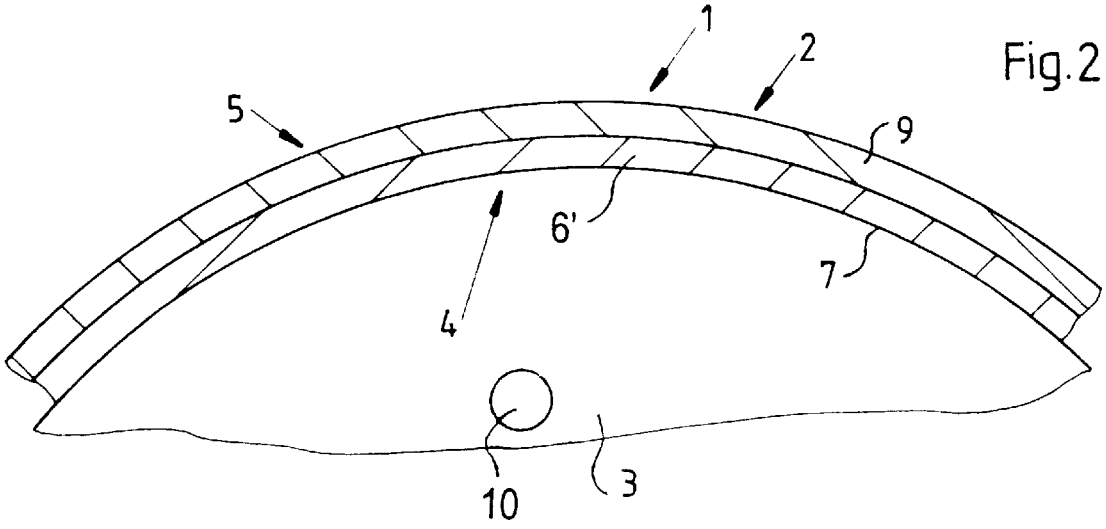
FIG. 2 is a view like that of FIG. 1 of an alternative embodiment of the invention.

FIG. 2 shows an alternative embodiment which differs from the embodiment in FIG. 1 by the provision of a heat-removing bottom layer 6' instead of the intermediate layer 6. This means that the heat-exchange layer 6' lies directly on the outer cylindrical surface 7 of the basic cylinder body 3 and that this heat-exchange layer 6' directly engages or adjoins the printing cover substrate 9. Moreover, by means of the embodiment of the invention shown in FIG. 2, the capability of attaining the desired temperature control is facilitated. As shown further in FIG. 2, a cooling device 10 may also be provided in the interior of the basic cylinder body 3.

In accordance with other otherwise non-illustrated alternative embodiments, it is possible to provide both a heat-removing bottom layer 6', as well as one or more heat-removing intermediate layers 6 in one printing cover 4.

I claim:

1. A blanket cylinder, comprising a basic cylinder body and a printing blanket disposed on an outer cylindrical surface of said cylinder body, the printing blanket comprising a plurality of layers including an outermost printing blanket layer and a heat-removing layer, said heat-removing layer being disposed between said outermost printing blanket layer of the printing blanket and the outer cylindrical surface of said cylinder body.

2. Cylinder according to claim 1, wherein said heat-removing layer is disposed directly on the outer cylindrical surface and forms a heat-conducting path to the cylinder body.

3. Cylinder according to claim 1, wherein the printing blanket is a sleeve-shaped blanket.

4. Cylinder according to claim 3, wherein said heat-removing layer is formed of a sleeve-shaped body embedded in said printing blanket.

5. Cylinder according to claim 1, wherein said heat-removing layer is arranged between the cylinder body and said outermost printing blanket layer.

6. Cylinder according to claim 1, including a cooling device arranged inside the cylinder body.

7. Cylinder according to claim 1, wherein said heat-removing layer is formed of thermally conductive material selected from the group of materials consisting of metal and synthetic resins.

8. Cylinder according to claim 7, wherein said metal is aluminum or nickel.

* * * * *